United States Patent [19]

Britz

[11] Patent Number: 4,519,176

[45] Date of Patent: May 28, 1985

[54] MODULAR METHOD OF MAKING A BUILDING STRUCTURE

[75] Inventor: Richard D. Britz, Eugene, Oreg.

[73] Assignee: Earthship Enterprise, Inc., Mt. Pleasant, Mich.

[21] Appl. No.: 392,643

[22] Filed: Jun. 28, 1982

[51] Int. Cl.[3] ..... E04B 1/62

[52] U.S. Cl. ..... 52/742; 52/169.11; 52/169.14

[58] Field of Search ..... 52/169.6, 169.7, 169.14, 52/169.11, 80, 236.2, 236.3, 742, 741, 515, 517, 2, 249; 264/32, 33, 34; 220/1 B, 18; 405/53-55

[56] References Cited

U.S. PATENT DOCUMENTS

| | | | |
|---|---|---|---|
| 2,335,300 | 11/1943 | Neff | 264/32 |
| 2,413,243 | 12/1946 | Neff | 52/169.14 |
| 2,499,478 | 3/1950 | Feser | 52/236.2 |
| 2,629,348 | 2/1953 | Kifferstein | 109/58 |
| 3,151,416 | 10/1964 | Eakin et al. | 52/742 |
| 3,212,220 | 10/1965 | Boniecki et al. | 52/80 |
| 3,365,855 | 1/1968 | Vermette | 52/741 |
| 3,482,005 | 12/1969 | Quentin | 264/33 |
| 3,898,776 | 8/1975 | Cox et al. | 52/79 |
| 3,916,578 | 11/1975 | Forootan et al. | 52/167 |
| 4,141,755 | 2/1979 | Weiss et al. | 52/517 |
| 4,315,385 | 2/1982 | Moreau et al. | 52/80 |
| 4,359,845 | 11/1982 | Harrison | 52/169.6 |

FOREIGN PATENT DOCUMENTS

| | | | |
|---|---|---|---|
| 872137 | 1/1942 | France | 52/169.6 |
| 2443546 | 8/1980 | France | 52/742 |

*Primary Examiner*—James L. Ridgill, Jr.

*Attorney, Agent, or Firm*—Basile, Weintraub & Hanlon

[57] ABSTRACT

A modular building structure includes a base formed with upper planar portion, a lower planar portion spaced from the upper portion to define an interior space therebetween and side walls extending between the upper and lower portions and having a convex, outwardly extending shape. A hollow upper shell with outer side walls is joined to the base. The base and upper shell are preferably constructed of an inner layer of concrete, an intermediate layer of an insulating material and an outer layer of a waterproof material. A plurality of modules are interconnected by hollow passageways which communicate with the interior of each module to define a continuous open space throughout the interconnected modules.

3 Claims, 4 Drawing Figures

MODULAR METHOD OF MAKING A BUILDING STRUCTURE

BACKGROUND OF THE INVENTION

1. Field of the Invention

This invention relates, in general, to building structures and, more specifically, to modular building structures and, even more specifically, to modular building structures adapted to be disposed partially or completely underground.

2. Description of the Prior Art

Building structures are typically supported on foundations of the pad footing or driven pile type. The stresses exerted on such foundations are resisted solely by the pad or pile surfaces. This has limited the location of buildings to areas having soil with a high bearing load capacity. Other types of soils, such as wet clay soils, have low bearing load capacities and do not provide sufficient support for typical building foundations thereby leaving vast areas unacceptable for the construction of buildings.

Building structures have also been devised with specially configured bases to resist subsurface vibrations or shocks of the type produced by earthquakes. Such building structures are typically constructed with a smoothly formed, continuous, arcuate or rounded bottom surface so as to increase the stability of the structure. Such base constructions, while effectively resisting subsurface vibrations and shocks, do little to permit the construction of such buildings on soils with low bearing load capacities.

Buildings have also been constructed in modular form from wood, metal or concrete pre-formed wall panels, frames and trusses which are assembled into a completed structure at the construction site. It is also known to construct modular building structures, tanks, etc., from concrete which is "shot" or sprayed over a frame which is then removed after the concrete sets or hardens.

It would be desirable to provide a modular building structure which can be constructed in soils having low bearing load capacities. It would also be desirable to provide a modular building structure which is adapted to be completely deployed underground. It would also be desirable to provide a modular building structure formed with a plurality of identically constructed modular units which may be interconnected in a variety of configurations and used on varying terrains. Finally, it would be desirable to provide a modular building structure which is economically and quickly formed of concrete which is "shot" or sprayed about a frame.

SUMMARY OF THE INVENTION

There is disclosed herein a unique modular building structure which includes a base formed of an upper planar portion, a lower planar portion spaced from the upper portion and upstanding side walls having an outwardly-facing convex shape which interconnect the upper and lower portions. A hollow upper shell having outer side walls is joined to the base.

The base and upper shell are preferably constructed of an inner layer of concrete, an intermediate layer of an insulating material and an outer layer of a waterproof material.

A plurality of modules are interconnected by means of hollow passageways which communicate with the interior of the upper shell of each module to form a continuous interior space throughout the interconnected modules.

A unique method of forming a modular building structure is also disclosed. The method includes the steps of:

(A) Forming a cavity in the ground having a planar bottom and upstanding, convex-shaped side walls;

(B) Applying a layer of a waterproof material over the interior surface of the cavity;

(C) Applying a layer of an insulating material over the layer of waterproof material;

(D) Applying a layer of concrete over the layer of insulating material to form a base with a hollow recess;

(E) Filling the recess in the base with inflatable means and a top layer of earth up to the upper edges of the side walls of the base;

(F) Applying a layer of concrete over the top of the base to form an upper planar portion for the base;

(G) Removing the inflatable means and earth from the interior of the base to define a hollow space therein;

(H) Mounting and interconnecting a plurality of frame panels on the base to form an upper shell frame;

(I) Applying concrete about the exterior of the upper shell frame;

(J) Applying a layer of an insulating material over the layer of concrete;

(K) Applying a layer of a waterproof material over the layer of insulating material; and (L) Removing the upper shell frame panels to form a hollow upper shell.

The modular building structure of the present invention includes a uniquely configured base which enables the modular building structure to be used in soils having low bearing load capacities which were previously unsuited for building structures. The construction of an integral base having a lower planar portion and upstanding side walls having a convex form enables a minimum thickness of material to be used to form the base and, at the same time, enables the entire base to act as a bearing surface which distributes forces throughout the entire modular building structure. The base in effect "nests" within the soil so as to be able to be used in soils having low bearing load capacity.

The construction of the base of the modular building structure of the present invention with a hollow interior space provides a lightweight base structure in which the interior space between the upper and lower portions of the base may be used for storage, building utilities, etc.

A plurality of modular units constructed in accordance with the teachings of the present invention may be interconnected by hollow passageways so as to enable a building structure to be configured in any desired shape with any number of modular building units and, further, a building structure which may be employed on terrains having varying slopes in which one or more of the modules is situated at a different level than the surrounding modules.

Finally, the unique method of constructing the modular building structure of the present invention provides an efficient, low cost construction method and, at the same time, ensures even stress distribution throughout the entire building structure.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
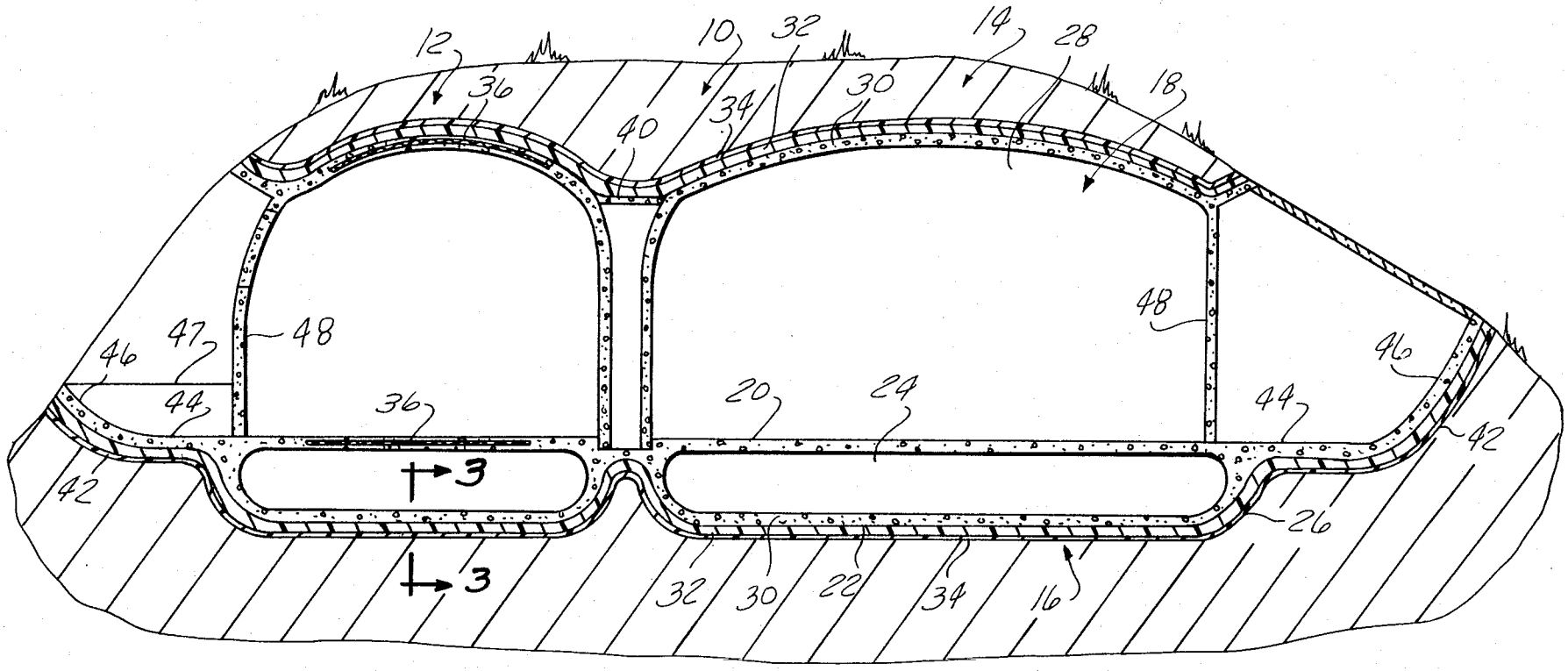
FIG. 1 is a cross sectional view of a modular building structure constructed in accordance with the teachings of the present invention.

Throughout the following description and drawing, an identical reference number is used to refer to the same component shown in multiple figures of the drawing.

Figure 2:
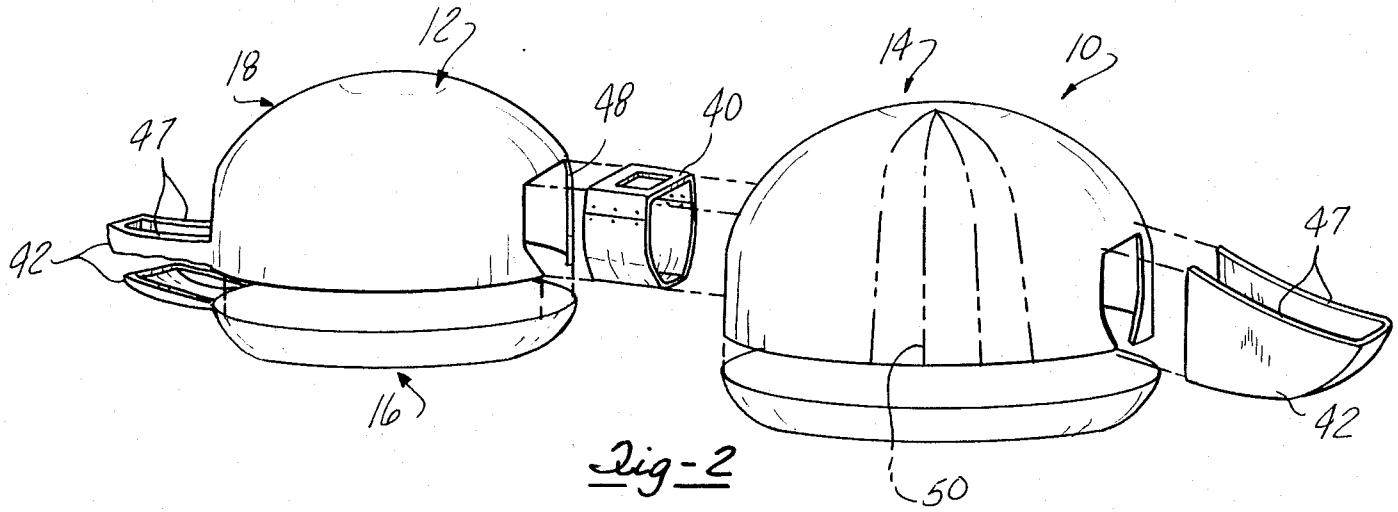
FIG. 2 is an exploded, perspective view depicting the interconnection of a plurality of modules.

Referring now to the drawing, and to FIGS. 1 and 2 in particular, there is illustrated a modular building structure 10 which is constructed in accordance with the teachings of the present invention. The building structure 10 of the present invention can be completely or partially disposed underground.

The building structure 10 is formed with one or more units or modules which are interconnected to form the building structure 10. The modules, such as modules 12 and 14, may be of the same size or have different heights and diameters depending upon the desired building structure configuration, building site terrain, occupant use, etc.

As the construction of each module is identical except for height and diameter, the construction of only one of the modules, such as module 14, will be described in detail.

Each module is formed with a base 16 and a hollow upper shell 18. The base 16 is formed with an upper portion 20 having a planar configuration and a lower portion 22, also having a planar configuration, which is spaced from the upper portion 20 to define a hollow interior space 24 therebetween. The base 16 also is formed with upstanding side walls 26 which have a convex configuration, with the convex face facing outward from the base 16. The entire upper portion 20, lower portion 22 and side walls 26 of the base 16 preferably have a circular plan shape, whose diameter may be varied depending on the particular size module that is desired.

The upper shell 18 has a hollow interior 28 formed by outer sides which are arranged in a generally hemispherical or elliptical ovoid configuration. The lower edges of the outer wall of the upper shell 18 are joined to the base 16 to complete the module 12 of the building structure 10 of the present invention.

Figure 3:
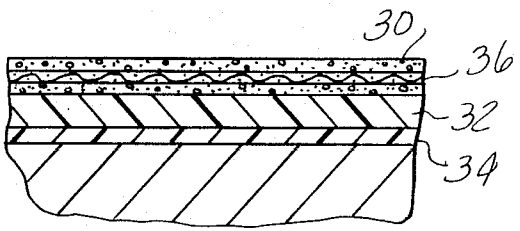
FIG. 3 is a cross sectional view, generally taken along line 3—3 in FIG. 1.

As shown in FIGS. 1 and 3, the base 16 and upper shell 18 are formed for a first, inner layer of concrete. Preferably, the first layer 30 is formed approximately 3 inches in thickness. A second layer 32 of an insulating material, such as polyurethane foam, is formed over the concrete layer 30. Again, the insulating layer has a preferred thickness of approximately 3 inches. Finally, a thin outer or third layer 34 of a waterproof material, such as a polymeric acrylic latex, is formed over the layer of insulating material 32 to provide a waterproof barrier for the module 12.

Additional waterproof capabilities for the module 12 of the present invention may be attained by using a crystalline-expansive type of waterproofing compound which is premixed with the concrete and which forms an additional waterproof barrier in the concrete layer 30.

According to another embodiment of the present invention, metal reinforcements 36 are added to the concrete layer 30 to provide additional strength for the building module 12. The metal reinforcements 36 may be in the form of chain-link fence bands which are disposed within the concrete layer 30. Additional steel reinforcement rods may be disposed between the links at maximum stress areas of the module 12 for added strength. Alternately, steel fibers may be employed in the concrete mix itself to provide additional strength for the module 12.

Referring now to FIG. 2, the plurality of building modules 12 and 14 are interconnected by means of hollow passageways or archways 40. The passageways 40 are formed with integral side walls, base and top surfaces and are disposed in communication apertures in the outer side walls adjoining modules 12 and 14 to form a continuous, open, interior space throughout the modules 12 and 14 forming the building structure 10.

The archways 40 are formed with the same material layers used to form the base 16 and upper shell 18 of the modules.

Base extensions or pads 42, shown in FIG. 1, are integrally formed with the base 16 of each module, such as modules 12 and 14, and extend outward therefrom to provide entranceways into the building structure 10 when it is disposed underground. The base extensions 42 are formed with a planar lower section 44, an upwardly extending curved portion 46 and spaced sides 47 which extend upward to the soil grade level.

Conventional doors, skylights, windows, etc., may be employed to complete the building structure 10 of the present invention. These elements are mounted in conventional wood or metal frames and are attached to mounting straps, not shown, which have been previously installed within and extend outward from the edges of the concrete layer 30.

Additional building equipment, such as ventilation equipment, may be mounted within the building structure 10 in communication with the exterior thereof in accordance with standard building codes. In addition, utilities, such as water holding tanks, heaters, air ducts, etc., used within the building structure 10 may be mounted within the hollow space 24 formed in the base 16 of each building module.

Figure 4:
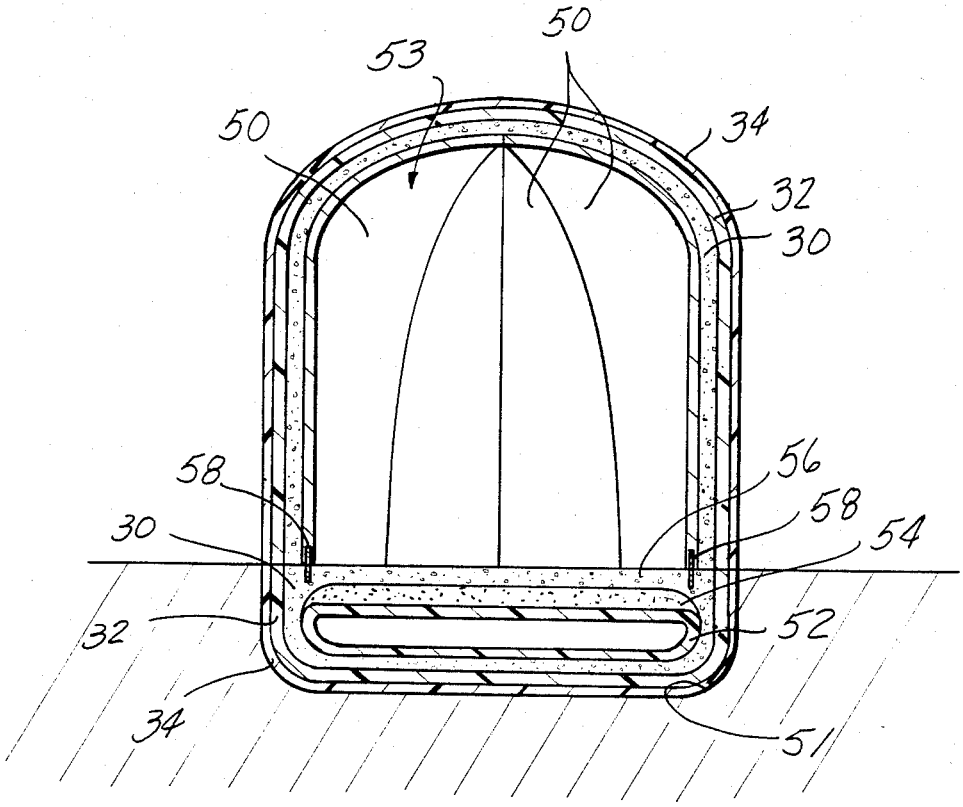
FIG. 4 is a cross sectional view, similar to FIG. 1, showing the method of constructing the modular building structure of the present invention.

As shown in FIG. 4, the modular building structure 10 is constructed by first excavating a hole 51 for each module at the building site which has a planar bottom and upstanding side walls having a substantially convex outwardly facing shape. The layer 34 of the waterproof material is applied or sprayed over the entire surface of the excavated hole 51. Next, the layer 32 of insulating material is applied over the layer 30 of waterproof material. Finally, the concrete layer 30 is applied, such as by spraying according to the known "shot" technique, over the insulating material layer 32 to complete the lower portion 22 and sides 26 of the base 16 of each module, such as modules 12 and 14, shown in FIG. 1.

A plurality of inflatable members 52, such as bladders, are placed within base 16 and covered with a thin layer 54 of earth and a layer 56 of concrete to form the upper portion 20 of each base 16. The inflatable members 52 are then deflated and removed along with the earth or sand from the base 16 to provide the hollow interior space 24 between the upper and lower portions 20 and 22 of each base 16.

To form the upper shell 18, a plurality of substantially identical frame panels, such as frame panels 50 shown in FIG. 4 and in phantom in FIG. 2, are mounted on top of the base 16 and interconnected to form an upper shell frame 53. The frame panels 50 have a generally eliptical ovoid form and certain frame panels may be provided with apertures to form the doors or entranceways between adjacent modules. When the upper shell frame 53 is completed, the metal reinforcements 36 are mounted thereover, such as by wrapping the chain link fence about the entire exterior surface of the upper shell frame 53. The layer 30 of concrete is then sprayed or shot over the upper shell frame in the desired thickness. Metal rods 58 which were previously mounted in the concrete layer 30 of the base 16 such that a portion extends upward from the base 16 provide a secure joinder between the upper shell 18 and the base 16 when the concrete layer 30 of the upper shell 18 is applied over the upper shell frame 53.

Next, the layers 32 and 34 of insulating material and waterproofing material, respectively, are sequentially applied, such as by spraying, over the concrete layer 30 and allowed to harden to complete each module of the building structure 10 of the present invention. The upper shell frame panels 50 are then removed from within the upper shell 18.

It should also be noted that the concrete, insulating material and waterproof material layers used to form the base 16 and upper shell 18 of each module are formed over all of the modules forming the building structure, the entranceways and the interconnecting passageways at the same time, as shown in FIG. 1, so as to form an integral, multi-unit building structure.

Thus, there has been disclosed a unique building structure which is adapted for use in soils having low bearing load capacities. The building structure of the present invention includes a uniquely configured base having a planar bottom or lower section and upstanding side walls having a convex form. The base nests within the soil and effectively distributes stresses exerted on the structure by the soil throughout the entire base and upper shell portions thereof.

The building structure of the present invention is also modular in form such that a plurality of identically constructed modules may be interconnected by means of hollow passageways to form a multi-unit building structure.

By distributing stresses throughout the entire building structure, the building structure may be formed with a minimum exterior wall thickness which minimizes costs and can be constructed by an efficient, low cost construction technique.

What is claimed is:

1. A method for constructing a modular building structure comprising the steps of:

(A) forming a cavity in the ground having a planar bottom and upstanding side walls having an outwardly facing convex shape;

(B) applying a layer of a waterproof material over the interior surface of the cavity;

(C) applying a layer of an insulating material over the layer of waterproof material;

(D) applying a layer of concrete over the layer of insulating material to form a base with a hollow recess;

(E) filling the recess with inflatable means and a top layer of earth up to the top edges of the side walls of the base;

(F) applying a layer of concrete over the top of the base to form an upper planar portion for the base;

(G) removing the inflatable means and earth from the interior of the base to define a hollow interior space between the upper and lower portions and the side walls of the base;

(H) mounting in registry a plurality of frame panels on the base to form an upper shell frame;

(I) applying concrete about the exterior of the upper shell frame;

(J) applying a layer of an insulating material over the concrete layer;

(K) applying a layer of a waterproof material over the layer of insulating material; and (L) removing the shell frame from the interior of the concrete layer to form a hollow upper shell.

2. The method of claim 1 wherein the concrete, insulating material and waterproof material layers forming the base and upper shell are applied by spraying.

3. A method for constructing a modular building structure comprising the steps of:

(A) Forming a base of a first layer of a waterproof material, a second layer of an insulating material and a third layer of concrete formed to have a lower portion and outwardly facing convex, outwardly extending side walls defining a hollow interior in the base;

(B) Forming a cavity in the ground having a planar bottom and upstanding side walls with a convex shape complimentary to the shape of the base;

(C) Applying a layer of concrete over the top of the base to form an upper planar portion and enclosing the hollow interior within the base;

(D) Mounting and interconnecting a plurality of frame panels on the base to form an upper shelf frame;

(E) Applying concrete about the exterior of the upper shelf frame;

(F) Applying a layer of insulating material over the concrete layer;

(G) Applying a layer of waterproof material over the layer of insulating material; and (H) Removing the shelf frame from the interior of the concrete layer to form a hollow upper shelf.

* * * * *